US006285136B1

(12) United States Patent
Fujii et al.

(10) Patent No.: US 6,285,136 B1
(45) Date of Patent: Sep. 4, 2001

(54) LIGHTING DRIVER FOR DISCHARGE LAMP

(75) Inventors: Akira Fujii, Yokkaichi; Yasuhiro Fukagawa, Anjo; Takumi Kataoka, Okazaki, all of (JP)

(73) Assignees: Denso Corporation, Kariya; Nippon Soken, Inc., Nishio, both of (JP)

( * ) Notice: Subject to any disclaimer, the term of this patent is extended or adjusted under 35 U.S.C. 154(b) by 0 days.

(21) Appl. No.: 09/528,195

(22) Filed: Mar. 17, 2000

(30) Foreign Application Priority Data

Mar. 18, 1999 (JP) ..... 11-074322

(51) Int. Cl.[7] ..... H05B 37/02

(52) U.S. Cl. ..... 315/209 PZ; 315/276; 315/209 R

(58) Field of Search ..... 315/209 PZ, 209 R, 315/224, 276, 291, 307, 362

(56) References Cited

U.S. PATENT DOCUMENTS 5,854,543 * 12/1998 Satoh et al. ..... 315/291
5,886,477 * 3/1999 Honbo et al. ..... 315/209 PZ
5,998,937 * 12/1999 Nishigaki ..... 315/209 PZ
6,075,325 * 6/2000 Kouno et al. ..... 315/276
6,118,221 * 9/2000 Kumasaka et al. ..... 315/307

FOREIGN PATENT DOCUMENTS 2767730 6/1994 (JP) .

* cited by examiner

*Primary Examiner*—Don Wong
*Assistant Examiner*—Wilson Lee
(74) *Attorney, Agent, or Firm*—Pillsbury Winthrop LLP

(57) ABSTRACT

A lighting driver for a discharge lamp is provided. The discharge lamp is designed to be ignited in response to application of a voltage higher than a given set voltage and to maintain stable emission of light through supply of a given current. The lighting driver includes two voltage source circuits one of which applies a first voltage having a first frequency to a piezoelectric transformer for igniting the discharge lamp and the other applying a second voltage of a second frequency for keeping stable emission of light from the discharge lamp. The lighting driver also includes a frequency switch which switches between communication of the first voltage source circuit with the piezoelectric transformer and communication of the second voltage source circuit with the piezoelectric transformer depending on whether the discharge lamp has been ignited or not, thereby keeping the stable emission of light from the discharge lamp after ignited.

4 Claims, 1 Drawing Sheet

LIGHTING DRIVER FOR DISCHARGE LAMP

BACKGROUND OF THE INVENTION

1. Technical Field of the Invention

The present invention relates generally to a discharge lamp lighting driver using a piezoelectric transformer which his designed to provide stable emission of light.

2. Background Art

Japanese Patent No. 2767730 discloses a conventional discharge lamp lighting driver. This driver is designed to apply the voltage having a frequency higher than a driving frequency of a piezoelectric transformer required to develop the voltage for igniting a discharge lamp and then sweep that frequency to a lower side until the discharge lamp is ignited. After the discharge lamp is ignited, the lighting driver continues to sweep the frequency of the voltage applied to the piezoelectric transformer to the lower side until the current required to keep stable emission of light from the discharge lamp is reached.

However, if a difference between the driving frequency of the voltage applied to the piezoelectric transformer required to produce the voltage for igniting the discharge lamp and that required to supply the current to the discharge lamp for keeping the stability of lighting of the discharge lamp is great, a discharge lamp lighting driver of the above described type encounters a drawback as will be discussed below.

FIG. 2 illustrates the relation between the current and voltage outputted to the discharge lamp from the piezoelectric transformer and the driving frequency of the voltage applied to the piezoelectric transformer.

The ignition of the discharge lamp is, as shown in the drawing, achieved by applying the voltage having a first frequency a to the piezoelectric transformer to output a first voltage A (X point), to the discharge lamp and lowering the first frequency a to a second frequency b required for stabilizing the lighting of the discharge lamp. The current supplied to the discharge lamp is then kept at B (Y point). If, however, a difference between impedance of the discharge lamp before ignited and that when the discharge lamp is placed in a stable condition is great, it will result in an increased interval between the first frequency a and the second frequency b, which may make it difficult to sweep the driving frequency of the voltage applied to the piezoelectric transformer from a to b within a short period of time. Specifically, the voltage having a frequency c (Z point) which is higher than the frequency b required for the stability of lighting of the discharge lamp is undesirably applied to the piezoelectric transformer. Therefore, after the discharge lamp is ignited, the voltage suitable for keeping the stable emission of light from the discharge lamp is not applied to the piezoelectric transformer, resulting in lack of current supplied to the discharge lamp.

SUMMARY OF THE INVENTION

It is therefore a principal object of the present invention to avoid the disadvantages of the prior art.

It is another object of the present invention to provide a discharge lamp lighting driver capable of keeping stable emission of light from a discharge lamp after ignited.

According to one aspect of the invention, there is provided a lighting driver for a discharge lamp designed to be ignited in response to application of a voltage higher than a given set voltage and to maintain stable emission of light through supply of a current having a given value. The lighting driver comprises: (a) a piezoelectric transformer connected electrically to the discharge lamp, the piezoelectric transformer being responsive to application of a first voltage having a first driving frequency to develop a voltage higher than the given set voltage required to ignite the discharge lamp and also responsive to application of a second voltage having a second driving frequency to supply a current to the discharge lamp which allows the discharge lamp to maintain stable emission of light; (b) a lighting detecting circuit detecting a status of the discharge lamp to provide a signal indicating whether the discharge lamp has been ignited or not; (c) a first voltage source circuit generating the first voltage having the first frequency; (d) a second voltage source circuit generating the second voltage having the second frequency; and (e) an applied voltage switching circuit switching between a first communication of the first voltage source circuit with the piezoelectric transformer and a second communication of the second voltage source circuit with the piezoelectric transformer, when it is required to ignite the discharge lamp, the applied voltage switching circuit establishing the first communication between the first voltage source circuit and the piezoelectric transformer to apply the first voltage having the first frequency to the piezoelectric transformer, after the discharge lamp is ignited, the applied voltage switching circuit being responsive to the signal from the lighting detecting circuit indicating that the discharge lamp has been ignited to block the first communication while establishing the second communication between the second voltage source circuit and the piezoelectric transformer to apply the second voltage having the second frequency to the piezoelectric transformer.

In the preferred mode of the invention, the lighting detecting circuit measures a current supplied to the discharge lamp to determine whether the discharge lamp has been ignited or not.

The first voltage source circuit first applies a voltage having a frequency higher than the first frequency and then sweeps at least the voltage to a lower side until the first frequency is reached.

A current controlling circuit is further provided which controls a current supplied to the discharge lamp, after the discharge lamp is ignited. The current controlling circuit controls the frequency of a voltage applied from the second voltage source circuit to the piezoelectric transformer to maintain the current supplied to discharge lamp at the given value.

BRIEF DESCRIPTION OF THE DRAWINGS

The present invention will be understood more fully from the detailed description given hereinbelow and from the accompanying drawings of the preferred embodiments of the invention, which, however, should not be taken to limit the invention to the specific embodiments but are for the purpose of explanation and understanding only.

In the drawings.

DESCRIPTION OF THE PREFERRED EMBODIMENTS

Figure 1:
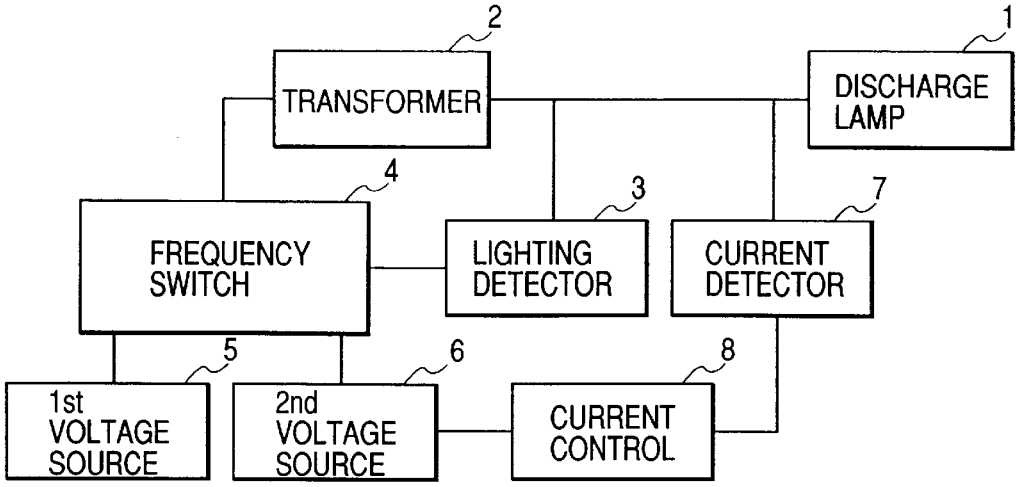
FIG. 1 is a block diagram which shows a lighting driver for a discharge lamp according to the present invention.

Referring now to FIG. 1, there is shown a discharge lamp lighting driver according to the invention.

The discharge lamp lighting driver is designed to control lighting of a discharge lamp 1 and includes generally a piezoelectric transformer 2, a lighting detecting circuit 3, a driving frequency switch 4, a first voltage source circuit 5, a second voltage source circuit 6, a current detector 7, and a current controlling circuit 8.

Figure 2:
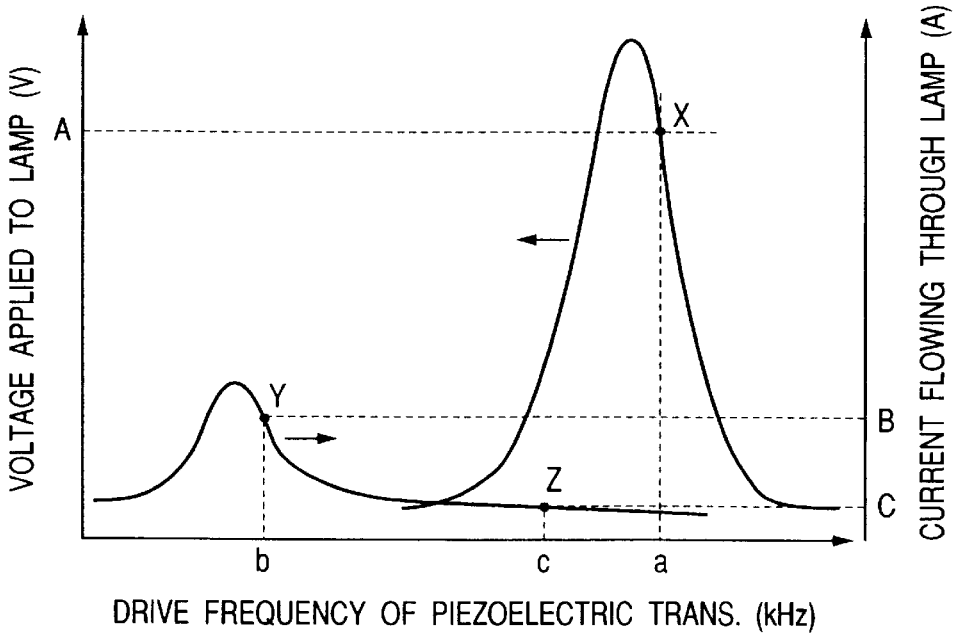
FIG. 2 is a graph which shows a relation between the current and voltage outputted to a discharge lamp from a piezoelectric transformer and a driving frequency of the voltage applied to the piezoelectric transformer.

The discharge lamp 1 used in this embodiment is, for example, a metal halide lamp which has characteristics, as shown in FIG. 2, wherein the discharge lamp 1 is ignited by application of a voltage higher than the voltage A and continues to light in a stable condition through supply of a current near the current B. For instance, the voltage A required for the ignition of the discharge lamp 1 is approximately 23 kV. The current B required for keeping the stable emission of light from the discharge lamp is approximately 1A.

The piezoelectric transformer 2 has a known structure and connects electrically with the discharge lamp 1. The piezoelectric transformer 2 is designed to develop the voltage A (23 kV) in response to application of the voltage having the first driving frequency a and maintain supply of the current B (1A) to the discharge lamp 1 in response to application of the voltage having the second driving frequency b. In practice, the developing of 23 kV (i.e., the voltage A) requires application of a voltage of 70 kHz to the piezoelectric transformer 2. The producing of the current B requires application of a voltage of 65 kHz to the piezoelectric transformer 2.

The lighting detecting circuit 3 monitors the magnitude of current flowing through the discharge lamp 1 to determine whether the discharge lamp 1 has been ignited or not and provides a signal indicative thereof to the driving frequency switch 4.

The current detector 7 detects or measures the current flowing through the discharge lamp 1 and provides a signal indicative thereof to the current controlling circuit 8.

The driving frequency switch 4 is responsive to the signal from the lighting detecting circuit 3 to selectively establish communication between the piezoelectric transformer 2 and the first voltage source circuit 5 and between the piezoelectric transformer 2 and the second voltage source circuit 6.

The first voltage source circuit 5 is designed to develop the voltage having the first driving frequency a. The second voltage source circuit 6 is designed to develop the voltage having the second driving frequency b. For example, the first driving frequency a. is 70 kHz which enables the piezoelectric transformer 2 to output a maximum voltage to the discharge lamp 1 before ignited. The second driving frequency b is 65 kHz near the frequency which enables the piezoelectric transformer 2 to supply a maximum current to the discharge lamp 1 during stable emission of light after ignited.

The current controlling circuit 8 is responsive to the signal from the current detector 7 to control the frequency of the voltage to be outputted from the second voltage source circuit. Specifically, after the discharge lamp 1 is ignited, and the driving frequency switch 4 switches the connection to the piezoelectric transformer 2 from the first voltage source circuit 5 to the second voltage source circuit 6, the current controlling circuit 8 adjusts the driving frequency of the voltage outputted from the second voltage source circuit 6 so that a preselected current (e.g., 1A) may flow from the piezoelectric transformer 2 to the discharge lamp 1.

In operation, when it is required to ignite the discharge lamp 1, the driving frequency switch 4 establishes the connection between the piezoelectric transformer 2 and the first voltage source circuit 5. The first voltage source circuit 5 starts to apply the voltage having the first driving frequency of 70 kHz to the piezoelectric transformer 2. This causes the piezoelectric transformer 2 to apply 23 kV to the discharge lamp 1, so that it is ignited.

The ignition of the discharge lamp 1 will cause an internal impedance thereof to drop instantly, thereby resulting in a rapid decrease in voltage applied to the discharge lamp 1, accompanying a sudden increase in current flowing through the discharge lamp 1. When the current flowing through the discharge lamp 1 exceeds a given value, the lighting detecting circuit 3 detects such a condition and outputs a signal to the driving frequency switch 4 which indicates that the discharge lamp 1 has been ignited. The driving frequency switch 4 is responsive to the signal from the lighting detecting circuit 3 to block the communication between the piezoelectric transformer 2 and the first voltage source circuit 5 and establish the communication between the piezoelectric transformer 2 and the second voltage source circuit 6, so that the voltage of 66 kHz is applied to the piezoelectric transformer 2. The piezoelectric transformer 2 develops a voltage of approximately 85 Vrms and applies it to the discharge lamp 1.

Subsequently, the current detector 7 measures the current flowing through the discharge lamp 1 to control the driving frequency of the voltage outputted form the second voltage source circuit 6 through the current controlling circuit 8 so that the current is supplied to the discharge lamp 1 which is required to maintain the stable emission of light.

While the present invention has been disclosed in terms of the preferred embodiments in order to facilitate better understanding thereof, it should be appreciated that the invention can be embodied in various ways without departing from the principle of the invention. Therefore, the invention should be understood to include all possible embodiments and modifications to the shown embodiments which can be embodied without departing from the principle of the invention as set forth in the appended claims.

For example, when it is required to ignite the discharge lamp 1, the first voltage source circuit 5 may first apply to the piezoelectric transformer 2 the voltage having a frequency higher than the first driving frequency a and then sweep it to a lower side until the first driving frequency a is reached.

The discharge lamp 1 may be of the type other than the metal halide lamp such as a cold-cathode tube.

What is claimed is:

1. A lighting driver for a discharge lamp designed to be ignited in response to application of a voltage higher than a given set voltage and to maintain stable emission of light through supply of a current having a given value, comprising:

a piezoelectric transformer connected electrically to the discharge lamp, said piezoelectric transformer being responsive to application of a first voltage having a first driving frequency to develop a voltage higher than the given set voltage required to ignite the discharge lamp and also responsive to application of a second voltage having a second driving frequency to supply a current to the discharge lamp which allows the discharge lamp to maintain stable emission of light;

a lighting detecting circuit detecting a status of the discharge lamp to provide a signal indicating whether the discharge lamp has been ignited or not;

a first voltage source circuit generating the first voltage having the first frequency;

a second voltage source circuit generating the second voltage having the second frequency; and an applied voltage switching circuit switching between a first communication of said first voltage source circuit with said piezoelectric transformer and a second communication of said second voltage source circuit with said piezoelectric transformer, when it is required to ignite the discharge lamp, said applied voltage switching circuit establishing the first communication between said first voltage source circuit and said piezoelectric transformer to apply the first voltage having the first frequency to said piezoelectric transformer, after the discharge lamp is ignited, said applied voltage switching circuit being responsive to the signal from said lighting detecting circuit indicating that the discharge lamp has been ignited to block the first communication while establishing the second communication between said second voltage source circuit and said piezoelectric transformer to apply the second voltage having the second frequency to said piezoelectric transformer.

2. A lighting driver as set forth in claim 1, wherein said lighting detecting circuit measures a current supplied to the discharge lamp to determine whether the discharge lamp has been ignited or not.

3. A lighting driver as set forth in claim 1, wherein said first voltage source circuit first applies a voltage having a frequency higher than the first frequency and then sweeps at least the voltage to a lower side until the first frequency is reached.

4. A lighting driver as set forth in claim 1, further comprising a current controlling circuit controlling a current supplied to the discharge lamp, after the discharge lamp is ignited, said current controlling circuit controlling a frequency of a voltage applied from said second voltage source circuit to said piezoelectric transformer to maintain the current supplied to the discharge lamp at the given value.

* * * * *